US011040228B2

(12) United States Patent
Ibarra

(10) Patent No.: US 11,040,228 B2
(45) Date of Patent: Jun. 22, 2021

(54) SAFETY HARNESS WITH A LOCKING PART FOR POSITIVELY IMMOBILISING FASTENING BUCKLES OF A STRAP CLOSURE AND ADJUSTMENT SYSTEM

(71) Applicant: BLUE ICE Europe, Les Houches (FR)

(72) Inventor: Juan-Manuel Ibarra, Crest (FR)

(73) Assignee: BLUE ICE Europe, Les Houches (FR)

( * ) Notice: Subject to any disclaimer, the term of this patent is extended or adjusted under 35 U.S.C. 154(b) by 0 days.

(21) Appl. No.: 16/481,374

(22) PCT Filed: Feb. 2, 2018

(86) PCT No.: PCT/FR2018/050260
§ 371 (c)(1),
(2) Date: Jul. 26, 2019

(87) PCT Pub. No.: WO2018/142084
PCT Pub. Date: Aug. 9, 2018

(65) Prior Publication Data

US 2019/0388717 A1 Dec. 26, 2019

(30) Foreign Application Priority Data

Feb. 3, 2017 (FR) ..... 17/50914

(51) Int. Cl.
*A62B 35/00* (2006.01)
*A44B 11/25* (2006.01)
*A44B 11/26* (2006.01)

(52) U.S. Cl.
CPC ..... *A62B 35/0031* (2013.01); *A62B 35/0018* (2013.01); *A44B 11/2569* (2013.01);
(Continued)

(58) Field of Classification Search
CPC ..... A62B 35/0031; A62B 35/0018; A62B 35/0037; A44B 11/2569; A44B 11/2588;
(Continued)

(56) References Cited

U.S. PATENT DOCUMENTS 2,152,049 A * 3/1939 Hedrick ..... A62B 35/00 182/9
2,175,571 A * 10/1939 Rose ..... A62B 35/00 182/4

(Continued)

FOREIGN PATENT DOCUMENTS

DE 102012013668 A1 1/2014
EP 3017847 A1 5/2016
WO WO-2018142084 A1 * 8/2018 ..... A62B 35/0018

OTHER PUBLICATIONS

International Search Report for Application No. PCT/FR2018/050260.
Written Opinion for Application No. PCT/FR2018/050260.

*Primary Examiner* — Daniel P Cahn
*Assistant Examiner* — Candace L Bradford
(74) *Attorney, Agent, or Firm* — Downs Rachlin Martin PLLC

(57) ABSTRACT

A safety harness comprises at least one strap, at least one attachment member for connecting the safety harness and a system for closing and adjusting the strap provided with a stationary fastening buckle secured to a first strand of the strap and a movable fastening buckle secured in such a way as to be adjustable along a second strand of the strap. The movable fastening buckle can cooperate with the stationary fastening buckle in an interlocking configuration in which the strap is closed on itself so as to form a closed loop having a perimeter that can be adjusted by adjusting the position occupied by the movable fastening buckle along the second stand. The safety harness comprises a locking part separate
(Continued)

from the stationary and movable fastening buckles, secured to the first strand or the second strand of the strap and capable of varying between an active state urging the two, stationary and movable, fastening buckles relative to each other so as to positively immobilise the stationary and movable fastening buckles in the interlocking configuration, and an inactive state in which the two, stationary and movable, fastening buckles can freely adopt and come out of the interlocking configuration.

18 Claims, 4 Drawing Sheets

(52) U.S. Cl.
CPC ..... *A44B 11/2588* (2013.01); *A44B 11/266* (2013.01); *A62B 35/0037* (2013.01)

(58) Field of Classification Search
CPC ..... A44B 11/266; A44B 11/258; A44B 11/25; A44B 11/25588
See application file for complete search history.

(56) References Cited

U.S. PATENT DOCUMENTS 2,252,998 A * 8/1941 Wachtel ..... A63B 27/00 182/6
2,807,852 A * 10/1957 Rave ..... A44B 11/2588 24/197
2,823,437 A * 2/1958 Anderson ..... A44B 11/2588 24/197
4,299,014 A * 11/1981 Wood ..... A44B 11/18 24/196
4,923,048 A * 5/1990 Cole ..... A62B 35/04 182/9
5,052,514 A * 10/1991 Rezmer ..... A01M 31/02 182/9
5,145,027 A * 9/1992 Petzl ..... A62B 35/0025 119/770
5,341,896 A * 8/1994 Amacker ..... A01M 31/02 166/270
5,411,461 A * 5/1995 Thomascik ..... A63C 3/00 280/1.5
D389,779 S * 1/1998 Poynter ..... D11/218
5,988,315 A 11/1999 Crane
6,027,172 A * 2/2000 Henshall ..... B64D 25/06 297/468
6,283,248 B1 * 9/2001 Groover ..... A62B 35/0025 182/6
6,869,146 B2 * 3/2005 Gollahon ..... A01K 97/10 182/235
7,752,722 B2 * 7/2010 Calkin ..... A41F 9/02 24/632
8,235,173 B2 * 8/2012 Kopp ..... A62B 35/0025 182/6
9,581,414 B1 * 2/2017 Mironski ..... A45F 5/021
9,737,737 B2 * 8/2017 Rullo ..... A62B 35/0037
10,245,460 B2 * 4/2019 Hetrick ..... A63B 21/4023
D872,200 S * 1/2020 Antezana ..... D21/692
2001/0047904 A1 * 12/2001 Antonio ..... A45F 5/021 182/3
2002/0074185 A1 * 6/2002 Colorado ..... A62B 35/0037 182/6
2004/0107547 A1 * 6/2004 Chung ..... A44B 11/2584 24/303
2007/0095873 A1 * 5/2007 Petzl ..... A62B 35/0025 224/660
2014/0082891 A1 * 3/2014 Hetrick ..... A44B 11/04 24/115 H
2017/0368388 A1 * 12/2017 Colorado ..... A62B 35/04

* cited by examiner

SAFETY HARNESS WITH A LOCKING PART FOR POSITIVELY IMMOBILISING FASTENING BUCKLES OF A STRAP CLOSURE AND ADJUSTMENT SYSTEM

CROSS REFERENCE TO RELATED APPLICATIONS

This application is a National Stage of PCT Application No. PCT/FR2018/050260 filed on Feb. 2, 2018, which claims priority to French Patent Application No. 17/50914 filed on Feb. 3, 2017, the contents each of which are incorporated herein by reference thereto.

FIELD OF THE DISCLOSURE

The present invention concerns a safety harness, comprising at least one strap, at least one attachment member for the tie-in of the safety harness and a system for closing the strap provided with a first fastening buckle secured to a first strand of the strap and a second fastening buckle secured to a second strand of the strap, the second fastening buckle being able to cooperate with the first fastening buckle in a mutual fastening configuration in which the strap is closed on itself to form a closed loop.

In a known manner in the field of climbing, mountaineering or for carrying out works at height, a safety harness also known as a «climbing harness», conventionally comprises at least one strap intended to be shaped into a closed loop by means of a closure and adjustment system to adjust the perimeter of the closed loop to the morphology of the user of the harness.

BACKGROUND

Such a strap is intended to form, in the configuration closed on itself in a closed loop, a tie-in belt intended to be disposed at the waist of the safety user of the harness, a thigh buckle for leg-strap, a buckle under gluteal, a buckle intended for setup on the torso of the user, a sling, etc. . . .

This type of safety harness can also be used in the ski field, for canyoning activities, or for speleology.

For the tie-in of the safety harness and the securing of the wearer, there is conventionally provided at least one attachment member arranged at the front of the tie-in belt. It may consist of an annular buckle fixedly mounted on the belt or slidably mounted along the belt.

The closure system is an essential element for safety and because of the weight it represents compared to the rest of the harness. It should be noted that looking for optimization of the weight of the harness may be a predominant criterion in some fields of use of the harness. Moreover, it is sometimes necessary to enable easy and fast adjustment of the strap in order to make the harness user-friendly in all situations.

There is a first family of closure and adjustment system based on the use of one single buckle trapped on the strap and configured to enable the strap to pass through the buckle in one direction at an adjustable location of: the strap and back through the buckle in the opposite direction in order to secure the fixing. While this system, conventionally known as the passing-passing back buckle, is safe and offers the possibility of a full opening (which may be interesting for example at the level of leg buckles), it does not enable quick and easy adjustment.

A second family of closure and adjustment system is based on the use of two metal buckles trapped at the same end of the strap, operating on the self-blocking principle and enabling full opening and quick adjustment. Nonetheless, the conferred safety is not optimal and the weight is considerable.

A third family of closure and adjustment system is based on the use of a movable fastening buckle occupying an adjustable position along one of the strands of the strap and a fixed fastening buckle mounted without adjustment at the end of the other strand of the strap.

A known solution of this third family is to use the buckles known under the common name of «rapco», for example as described in the patent US2807852A, generally by means of respectively two movable and fixed metal attachments, the movable attachment being intended to be superimposed on the fixed attachment in order to create a pinch of the strap strand that passes through the movable fastener. While this system enables a total opening of the strap and a quick adjustment, it does not provide sufficient safety because the attachments are likely to open accidentally when the tension of the strap is not sufficient. This risk is particularly present for the safety harnesses whose attachment member (for the tie-in of the harness and the safety of the wearer of the harness) is movably mounted along the belt because the attachment member thus sliding is likely to lift one of the attachments until authorizing the unlocking thereof.

Another solution of the third family is described in the U.S. Pat. No. 5,988,315A but the described harness does not address the problems hereinabove.

BRIEF SUMMARY

The present invention aims at solving all or part of the drawbacks listed hereinabove.

In this context, there is a need to provide a safety harness with a closure system that is lightweight, simple, and economical to manufacture, which enables a full opening of the strap and a possible quick adjustment, while being completely safe and avoiding any risk of accidental opening of the strap.

To this end, there is proposed a safety harness, comprising at least one strap, at least one attachment member for the tie-in of the safety harness, and a system for closing the strap provided with a first fastening buckle secured to a first strand of the strap and a second fastening buckle secured to a second strand of the strap, the second fastening buckle being able to cooperate with the first fastening buckle in a mutual fastening configuration in which the strap is closed on itself to form a closed loop. The safety harness comprising a locking part independent of the first and second fastening buckles, and secured to the first strand of the strap or to the second strand of the strap and adapted to vary between a first configuration in which it occupies an active state in which it biases the first and second fastening buckles relative to each other in a manner ensuring a positive blocking of the first and second fastening buckles in the mutual fastening configuration, and a second configuration in which it occupies an inactive state in which the first and second fixed and movable fastening buckles can freely adopt or leave the mutual fastening configuration.

The safety harness may implement the advantageous following features, considered separately or in combination.

The locking part comprises mechanical elements allowing biasing the first and second fastening buckles relative to each other when they adopt their mutual fastening configuration, by exerting a mechanical tension thereon opposing the relative displacement of the first and second fastening buckles.

The first fastening buckle is fixed by being fixedly secured to the first strand of the strap and the second fastening buckle is movable by being adjustably secured to the second strand of the strap so that the closure system enables an adjustment of the strap such that the closed loop formed when the strap is closed on itself in the mutual fastening configuration of the first and second fastening buckles has a perimeter adjustable by adjusting the position occupied by the second fastening buckle relative to the second strand of the strap.

The safety harness comprises fixing means ensuring a positive blocking of the locking part in its active state by fixing on at least one of the fastening buckles.

The fixing means comprise mechanical snap-fitting elements and/or magnetic elements.

The passage of the locking part from the first configuration to the second configuration and vice versa results from a change of position of the locking part relative to the strand of the strap to which the locking part is secured.

The locking part is mounted in a sliding manner on the strand of the strap to which it is secured, the change of position of the locking part being performed by sliding along the strand of the strap.

In a first embodiment, one of the first and second fastening buckles is in the form of a male buckle made of a rigid material and the other of the first and second fastening buckles is in the form of a female buckle formed as a closed loop made of a flexible material, the male buckle being provided to fit through the female buckle and to be gripped to the female buckle after insertion.

The locking part is in the form of a link formed in a flexible and elastically deformable material and arranged in the form of a closed loop whose ends are fastened to the strand of the strap to which the male buckle is secured and/or to the male buckle, said link being adapted, when it adopts the first configuration corresponding to its active state, to trap the female buckle in combination with the male buckle and to exert a mechanical tension on the male and female buckles preventing the male buckle from leaving the female buckle.

In a second embodiment, the first and second fastening buckles are constituted respectively by first and second attachments adapted to cooperate with each other, when they adopt mutual fastening configuration, by simple bearing against each other, where the second attachment is superimposed on the first attachment, the first attachment being secured to a free end of the first strand of the strap, the second attachment enabling the second strand of the strap to pass through the second attachment by forming a bend in the form of a simple ring, the first and second attachments causing a pinch of the second strand of the strap at the level of said bend between the first and second attachments, the pinch force increasing with the tension applied on the first and second strands of the strap.

In its active state, the locking part biases the first and second attachments so as to exert thereon a mechanical tension opposing the relative displacement between the first and second attachments in a manner ensuring a positive blocking of the pinch of the second strand of the strap between the first and second attachments and preventing the second attachment, in its position superimposed on the first attachment, from passing throughout an opening of the first attachment through which it has passed to occupy said superimposed position.

The locking part delimits a slider slidably mounted on the second strand of the strap which is secured to the second attachment and a housing in which a portion of the first attachment and/or of the second attachment, when the first and second attachments adopt the mutual fastening configuration by simple bearing, is adapted to be inserted, the slider and the housing being superimposed so that when said portion of the first attachment and/or of the second attachment is inserted into the housing, the locking part, via the connection between the second attachment and the slider of the locking part formed by the second strand, opposes the lifting of the second attachment bearing on the first attachment.

The locking part is equipped with a foolproof system ensuring that the locking part can be placed in its first configuration and in its active state if a first face of the second attachment bears against the first attachment and that the locking part cannot be placed in its first configuration and in its active state if a second face of the second attachment, opposite to said first face, bears against the first attachment.

The first and second attachments are permanently secured to each other.

The locking part is formed in a rigid material.

BRIEF DESCRIPTION OF THE DRAWINGS

The invention will be better understood using the following description of particular embodiments of the invention provided as non-limiting examples and represented in the appended drawings, in which.

DETAILED DESCRIPTION

Figure 1:
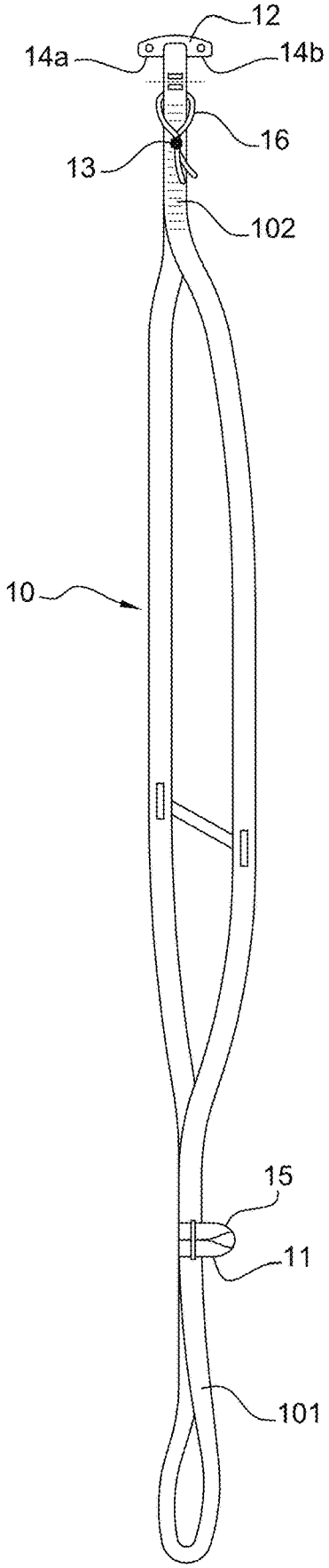
FIG. 1 is a general view of a tie-in belt of a first exemplary embodiment of the safety harness according to the invention, apart from the situation of mutual fastening configuration of the two fastening buckles.

Referring to the appended FIGS. 1 to 6 as summarily presented hereinabove, the invention essentially concerns a safety harness comprising at least one strap 10, at least one attachment member (not represented) enabling the tie-in of the safety harness in order to secure the wearer of the harness, and a system for closing the strap 10.

In general, the safety harness is intended to be used in mountaineering, climbing, work at height, canyoning, skiing, or even speleology.

The strap 10, once closed over itself by means of the closure system so as to form a closed loop, is intended to form for example, a tie-in belt (as is the case in the two embodiments represented in FIGS. 1 to 5) intended to be placed at the waist of the user but could equally constitute a thigh buckle, a belt under gluteal, a belt to be used at the level of the torso, a sling, etc. . . . For example, the strap 10 is made of a synthetic fabric, in particular in high density polyethylene, and possibly an upholstery structure such as, for example, a filler foam in certain areas of its length.

The attachment member is in particular arranged at the front of the tie-in belt to ensure the tie-in of the belt and therefore of the harness. The attachment member is for example constituted by an annular buckle, formed in a rigid material or in a flexible material, secured to the belt by being fixedly mounted along the latter or conversely by being mounted in a sliding manner along the front portion of the belt.

The nature of the strap 10 and that of the attachment member are not per se an important part of the invention. However, the nature of the closure system is an important aspect, and will be the object of a detailed description of two conceivable embodiments, both of which correspond to the same inventive concept which. will. be presented later, in support of three examples, respectively in FIGS. 1, 3 and 6.

For reasons of simplicity of understanding and reading, elements having a similar function from one embodiment to another will keep the same reference numerals in all FIGS. 1 to 6, even if the shape and design of these elements are different from one embodiment to another.

In general, the closure system is intended to be able to close the strap 10 on itself in order to form a closed loop, or on the contrary, to be able to completely open the buckle. This may be very interesting, for example, when the strap is intended to constitute a thigh buckle in order to facilitate the clip-in. The closure and the opening of the strap 10 must be very easy and fast, in order to offer optimal user-friendliness to the safety harness. The weight of the closure system must be as large as possible. Finally, the closure system is configured to prevent any inadvertent opening of the closed loop defined by the strap 10, for safety reasons.

In the two embodiments described later on with reference to FIGS. 1 and 2 and FIGS. 3 to 6 respectively, the closure system is provided with a first fastening buckle 11 secured to a first strand 101 of the strap 10 and a second fastening buckle 12 secured to a second strand 102 of the strap 10. The second fastening buckle 12 is adapted to cooperate with the first fastening buckle 11 so as to adopt a mutual fastening configuration in which the strap 10 is closed on itself to form a closed loop.

Essentially, the two embodiments respectively of FIGS. 1 and 2 and FIGS. 3 to 6 differ from each other as to the nature of the fixed first fastening buckle 11 and of the second fastening buckle 12 and as to the nature of cooperating with each other in the mutual fastening configuration.

Figure 6:
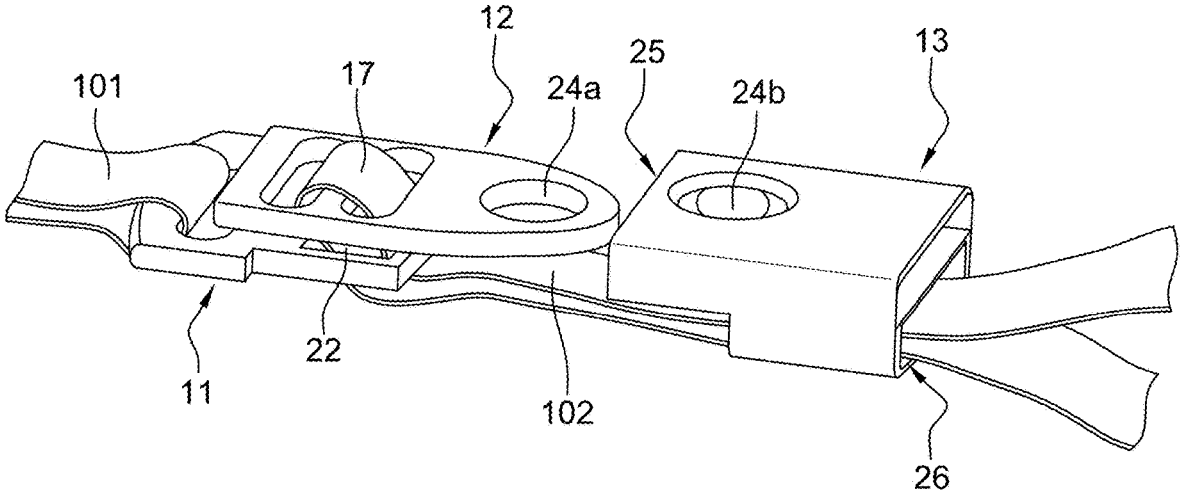
FIG. 6 shows the closure system of a third exemplary embodiment of the safety harness according to the invention, the fastening buckles being in a fastening situation and the locking part being in its inactive state.

In addition, in the two embodiments described later on with reference to FIGS. 1 and 2 and FIGS. 3 to 6 respectively, the closure system comprises a locking part 13 independent of the first fastening buckle 11 and of the second fastening buckle 12. The locking pan 13 may be secured to the first strand 101 of the strap 10 to which the first fastening buckle 11 is secured or to the second strand 102 of the strap 10 to which the second fastening buckle 12 is secured. The locking part 13, thereby captive, is adapted to vary by actuation of the user between a first configuration in which it occupies an active state (FIG. 2 for the first embodiment illustrated in the first example of FIGS. 1 and 2; FIG. 4 for the first example of the second embodiment illustrated in FIGS. 3 to 5) in which it biases the first and second fastening buckles 11, 12 relative to one another in a manner ensuring a positive blocking of the first and second fastening buckles 11, 12 in the mutual fastening configuration, and a second configuration in which it occupies an inactive state (FIG. 1 for the first embodiment illustrated in the first example of FIGS. 1 and 2; FIG. 6 for the second example of the second embodiment illustrated in FIG. 6) in which the first and second fastening buckles 11, 12 can freely adopt or leave the mutual fastening configuration.

Locking pan 13 comprises mechanical elements, which will be detailed later on, allowing biasing the first and second fastening buckles 11, 12 relative to each other when these adopt their mutual fastening configuration, by exerting a mechanical tension thereon opposing the relative displacement of the first and second fastening buckles 11, 12. The nature of the mechanical elements thus mentioned and the manner of forming them structurally vary between the first embodiment and the second embodiment, even though the general principle is common to both embodiments.

The two embodiments of FIGS. 1 and 2 and FIGS. 3 to 6 respectively also differ from each other as to the nature of the locking part 13 and as to the nature of occupying the active state for positive blocking purposes as described above.

By positive «blocking in the mutual fastening configuration», it should he herein understood that the mutual fastening configuration is definitely guaranteed by the locking part 13 as long as no action specifically required to place the locking part in its inactive state is applied to the locking part 13 by the wearer of the safety harness.

In a non-limiting manner, it is advantageous to provide for the first fastening buckle 11 being fixed by being fixedly secured to the first strand 101 of the strap 10 and the second fastening buckle 12 being movable by being adjustably secured on the second strand 102 of the strap 10 so that the closure system enables an adjustment of the strap 10 such that the closed loop formed when the strap 10 is closed on itself in the mutual fastening configuration of the first and second fastening buckle 11, 12 has an adjustable perimeter by adjusting the position occupied by the second fastening buckle 12 relative to the second strand 102 of the strap 10. Regardless of the concerned embodiment, it remains quite possible to consider that each of the first and second fastening buckles 11, 12 is fixed by being fixedly secured to the strand 101,102 on which it is mounted.

According to a particular embodiment, the safety harness comprises fixing means that provide a positive blocking when the locking part 13 is in its active state by fixing on at least one of the first and second fastening buckles 11, 12. Thus, it is possible to provide for the locking part 13, when it occupies its active state itself ensuring the positive blocking of the fastening buckles 11, 12 in their mutual fastening configuration, being fixed by means of a positive blocking to the first buckle 11 and/or to the second buckle 12 by these fixing means. An example of such fixing means is described below and illustrated in FIG. 6. The fixing means may in particular comprise mechanical snap-fitting elements and/or magnetic elements, which is effective, economical, and lightweight. The fixing means may comprise first elements secured to the locking part 13 and complementary second elements secured to the fastening buckle 11, 12 to which it is fixed.

By «positive blocking in the active state», it should be herein understood that the active state of the locking part 13 is definitely guaranteed by the fixing means as long as no action specifically required to unlock the fixing means is applied to the fixing means by the wearer of the safety harness.

The passage of the locking part 13 from the first configuration in which it occupies its active state to the second configuration in which it occupies its inactive state, and vice versa, results from a change of position of the locking pan 13 relative to the strand 101, 102 of the strap 10 to which the locking part 13 is secured. In particular, in the second embodiment of FIGS. 3 to 5, the locking part 13 is mounted in a sliding manner on the strand 101, 102 of the strap 10 to which it is secured, the change of position of the locking part 13 being performed by sliding along this strand 101, 102 of the strap 10. The locking part 13 may be equipped with a sliding guide means provided to this end, shown, for example, in FIG. 6. In the case of the first embodiment with reference to FIGS. 1 and 2, the change of position of the locking part 13 to pass from the active state to the inactive state and vice versa is performed by a tilting of the locking part 13 relative to the strand to which it is secured.

Figure 2:
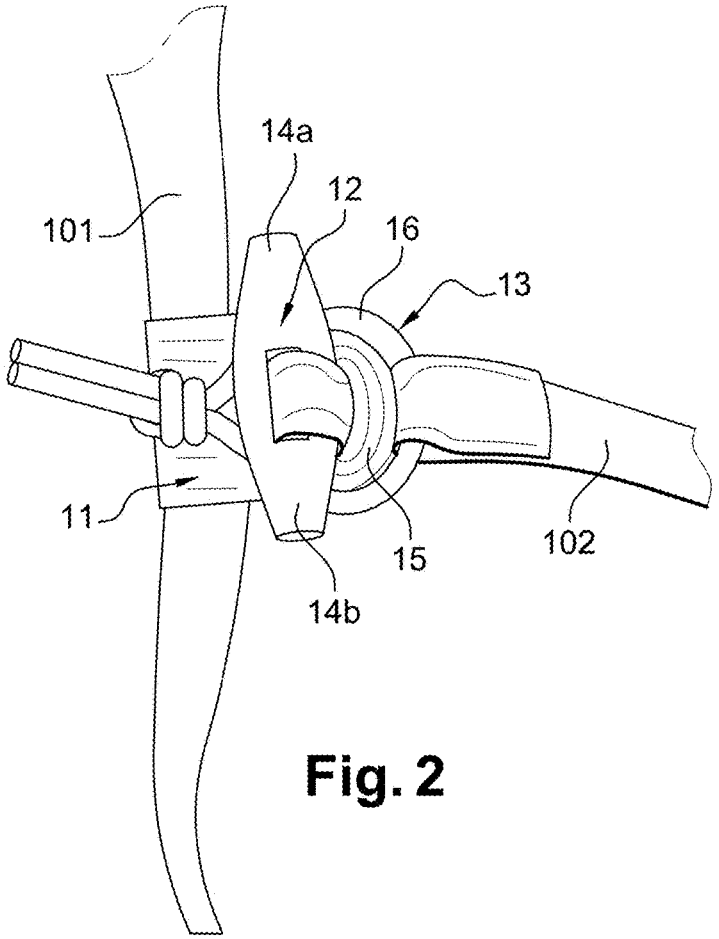
FIG. 2 is a detail view of the tie-in belt of FIG. 1 at the level of the fastening buckles, in a situation of mutual fastening configuration of the fastening buckles and active state of the locking part.

Referring now more specifically to the first embodiment of FIGS. 1 and 2, one of the first and second fastening buckles 11, 12 is in the form of a male buckle made of a rigid material and the other of the first and second fastening buckles 11, 12 is in the form of a female buckle formed as a closed loop made of a flexible material, the male buckle being provided to fit through the female buckle and to be gripped by the female buckle after insertion.

In the illustrated example, the male buckle is in the form of a plastic part provided with two lateral projections 14*a*, 14*b* for gripping to the female buckle which is made herein by a closed loop 15 made of a flexible synthetic material.

For example, the male buckle acts as a movable fastening buckle whereas the female buckle in the form of a closed loop 15 constitutes a fixed fastening buckle, even though an inverted arrangement may be considered depending, on the design of the strap 10. Still alternatively, the two male and female buckles may constitute two tried fastening buckles 11, 12 in the ease where the closure system is not intended to enable a perimeter adjustment.

Moreover, in the first embodiment of FIGS. 1 and 2, the locking part 13 is in the form of a link 16 formed in a flexible and elastically deformable material and arranged in the form of a closed loop. In the figures, the ends of this link 16 are fastened to the strand 101, 102 of the strap 10 to which the male buckle is secured. Alternatively or in combination, in a non-represented manner, the two ends of the link 16 could be fastened directly to the male buckle, typically at the level of the two lateral projections 14*a*, 14*b* respectively. The link 16 is configured to trap the female buckle, when the link 16 adopts the first configuration corresponding to its active state, in combination with the male buckle and to exert a mechanical tension on the male and female buckles preventing the male buckle from leaving the female buckle. In the represented example, the link 16 is constituted in the form of two strands knotted together at their distal ends whereas their proximal ends are secured to the strand 102 of the strap 10.

In order to pass the link 16 constituting the locking pat 13 in the active state, all it needs, once the male buckle is in a mutual fastening position with the female buckle (this being previously obtained by insertion of the male buckle throughout the closed loop 15 until gripping of the lateral projections 14*a*, 14*b* on the closed loop 15), is to displace the link 16 by tilting relative to the strand of the strap 10 whose link is secured so as to make the male buckle pass through the link 16 until gripping of the lateral projections 14*a*, 14*b* on the link 16. The link 16 then traps the closed loop 15 in combination with the part constituting the male buckle and, at least by its elasticity, exerts a mechanical tension on the male buckle and on the closed loop 15 preventing any disengagement of the male buckle from the closed loop 15 as long as the link 16 is in place. Hence, a positive blocking is obtained because it will be maintained as long as the link 16 is not specifically removed from the lateral projections 14*a*, 14*b* by a reverse tilting, regardless of the tension exerted on the strands 101, 102 of the strap 10.

It is therefore herein understood that the mechanical elements provide a biasing of the first and second fastening buckles 11, 12 relative to one another when these adopt their mutual fastening configuration, by exerting a mechanical tension thereon opposed to the relative displacement of the first and second fastening buckles 11, 12. The biasing is obtained by the link 16 in a closed loop by its ability to enclose the female buckle in combination with the male buckle and by a length of the link 16 adapted so that when it traps the female buckle, the link is elastically deformed in order to exert reciprocally the mechanical tension that biases the male and female buckles in the manner ensuring their positive blocking in the mutual fastening configuration.

Referring now more specifically to the second embodiment of FIGS. 3 to 6, the first and second fastening buckles 11, 12 are constituted respectively by first and second attachments adapted to cooperate with each other, when these adopt the mutual fastening configuration (FIGS. 4 to 6) by simple bearing against each other where the second attachment is in a position superimposed on the first attachment. For example, the first and second attachments are generally in the form of metal plates generally planar and perforated at their center so as to delimit a respective central opening. The second attachment is intended to bear against an upper face 23 or the first attachment. The first attachment is secured, for example fixedly secured, to a free end of the first strand 101 of the strap 10, typically by being trapped in a loop closed on itself formed at the free end of the first strand 101 of the strap 10. The second attachment enables the second strand 1.02 of the strap 10 to pass through the second attachment, at the level of its central opening, forming a bend 17 in the form of a simple ring. The position of the second attachment is for example adjustable along the second strand 102 by sliding more or less the second attachment along the second strand 102. The first attachment and the second attachment cause a pinch 18 of the second strand 102 of the strap 10 at the level of the bend 17 between the first and second attachments. The force of this pinch 18 increases concomitantly with the tension applied on. the first and second strands 101, 102 of the strap 10.

In a variant as represented in FIGS. 3 to 6 but not limited thereto, the second attachment is adapted to pass through the opening 22 delimited by the first attachment to adopt the mutual fastening configuration. In this variant, the locking part 13 advantageously allows, besides ensuring the positive blocking of the pinch 18 of the second strand 102 at the level of the bend 17 formed through the second attachment, to prevent the second attachment, in its position superimposed on the first attachment, to pass throughout the opening 22 of the first attachment even though the tension applied to the strap 10 becomes weak.

In other words, in the second embodiment, the kicking pan 13 biases in its active state the first and second attachments so as to exert thereon a mechanical tension opposing the relative displacement between the first and second attachments. This mechanical tension exerted by the locking part 13 on the one hand ensures a positive blocking of the pinch 18 of the second strand 102 of the strap 10 between the first and second attachments and on the other hand prevents the second attachment, in its position superimposed on the first attachment (FIGS. 4 to 6), from passing through the central opening 22 of the first attachment through which it has previously passed to occupy said superimposed position.

This positive blocking is present independently of the tension exerted on the strands 101, 102 of the strap 10.

Figure 3:
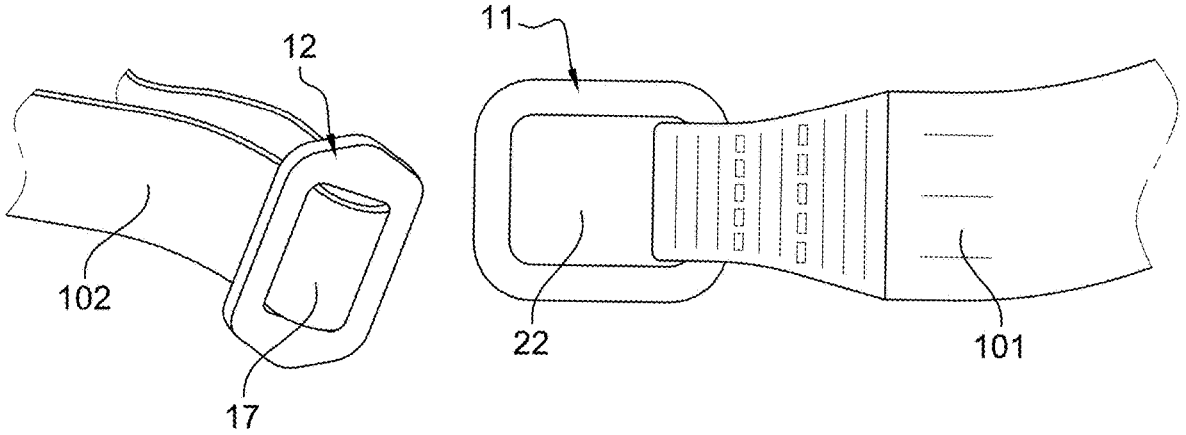
FIG. 3 shows the two fastening buckles of the tie-in belt of a second exemplary embodiment of the safety harness according to the invention, apart from the situation of mutual fastening configuration of the fastening buckles.
Figure 4:
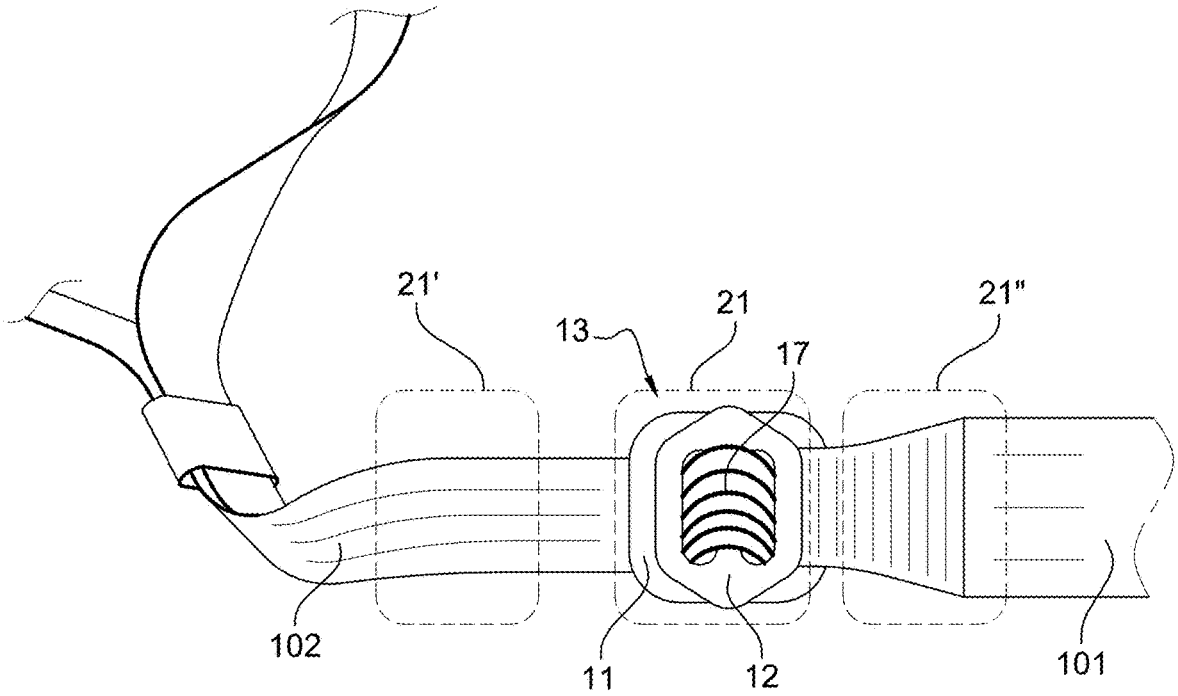
FIG. 4 illustrates the two fastening buckles of FIG. 3 in a situation of mutual fastening configuration and active state of the locking part.
Figure 5:
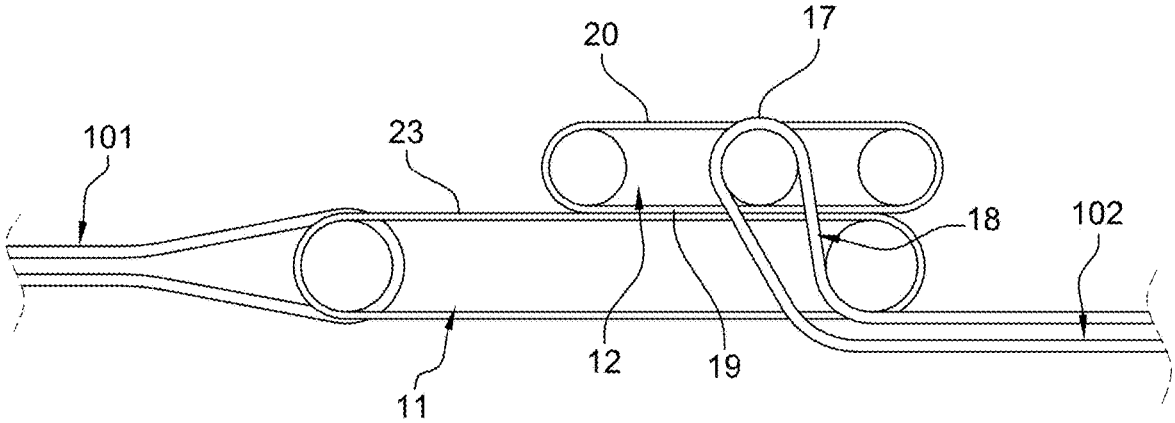
FIG. 5 is a longitudinal sectional view of the two fastening buckles of FIGS. 3 and 4 in a situation of mutual fastening configuration and inactive state of the locking part.

In FIG. 3, the two attachments are not yet in the mutual fastening configuration. In order to occupy this configuration, it is necessary to pass the second attachment, having been previously mounted on the second strand 102 of the strap 10 by forming the bend 17, through the opening 22 of the first attachment and to bear the second attachment on the upper face 23 of the first attachment. This leads to the configuration shown in FIG. 5, the pinch 18 being present. It should be noted that this pinch 18 occurs and in a self-blocking manner only if the second attachment simply bears on the first attachment by its first face 19 whereas this pinch 18 does not occur if the second attachment bears against the first attachment by its second face 20 opposite to the first face 19 in the direction of the thickness of the second attachment.

Therefore, according to a non-limiting embodiment, the locking part 13 is equipped with a foolproof system ensuring that the locking part 13 can be placed in its first configuration and in its active state if the first face 19 of the second attachment bears against the first attachment and ensuring that the locking part 13 cannot be placed in its first configuration and in its active state if the second face 20 of the second attachment bears against the first attachment.

In FIG. 4, the reference 21 represents the position occupied by the locking part 13 when it is in its first configuration and, therefore, it occupies its active state. The reference 21' represents the position occupied by the locking part 13 when it is in its second configuration and, therefore, it occupies its inactive state, assuming that the locking part 13 would be secured, typically by being mounted in a sliding manner, to the second strand 102 of the strap 10 to which the second fastening buckle 12 is also secured. Finally, the reference 21" represents the position occupied by the locking part 13 when it is in its second configuration and, therefore, it occupies its inactive state, assuming that the locking part 13 would be secured, typically by being mounted in a sliding manner, to the first strand 101 of the strap 10 to which the first fastening buckle 11 is also secured.

In a variant which is not represented, the first and second attachments are secured to one another permanently, in particular by being pivotally mounted relative to each other.

FIG. 6 illustrates, in the form of a second exemplary embodiment, another possible variant of the second embodiment of a safety harness according to the invention. Thus, in this example with reference to FIG. 6, the closure system comprises, as in the case of FIG. 3, a first attachment which constitutes the first fastening buckle, a second attachment which constitutes the second fastening buckle 12 and a locking part 13. The locking part 13 delimits a slider 26 mounted in a sliding manner on the second strand 102 of the strap 10 to which the second attachment is secured and a housing 25 in which a portion of the second attachment, when the first and second. attachments adopt the mutual fastening configuration by simply bearing on each other, is adapted to be inserted. The slider 26 and the housing 25 are superimposed transversely to the direction in which the second strand 102 extends and. are delimited by the locking part 13, the slider and housing being integrally formed in. a rigid material such as for example a steel or a plastic. At the level of the second attachment, the strap 10 forms a bend 1.7 in the same manner as was described for the first example represented in FIGS. 3 to 5, The first attachment and the second attachment cause a pinch. of the second strand 102 of the strap 10 at the level of the bend 17 between the first and second attachments. The force of this pinch increases concomitantly with the tension applied on the first and second strands 101, 102 of the strap 10. In its active state which results from the insertion of the corresponding portion of the second attachment into the housing 25, the locking part 13 biases the first and second attachments so as to exert thereon a mechanical tension opposing the relative displacement between the first and second attachments. This mechanical tension exerted by the locking part 13 on the one hand ensures the positive blocking of the pinch of the second strand 102 of the strap 10 between the first and second attachments and on the other hand prevents the second attachment, in its position superimposed on the first attachment, from passing throughout the central opening 22 of the first attachment through which it has previously passed to occupy said superimposed position. This positive blocking is present regardless of the tension exerted on the strands 101, 102 of the strap 10. The arrangement of the slider 26 and the housing 25 as thus described and illustrated allows in practice, when the portion of the second attachment is inserted in the housing 25, the locking part 13, via the connection between the second attachment and the slider 26 of the locking part 13 to be concretely formed by the second strand 102, and opposes the lifting the second attachment from the first attachment. By blocking any possibility of the second attachment lifting relative to the first attachment, thanks to the mechanical tension exerted by the locking part 13 via the strand 102 of the strap 10, the locking part 13 ensures, when in the active state, the positive blocking of the two attachments in their mutual fastening configuration.

As already described, the slider 26 allows for the change of state of the locking part to be performed by a sliding position change of the locking part along the strand 102 of the strap 10.

It is herein specified that the housing 25 may be provided to receive, in addition to the portion of the second attachment which is inserted therein or in substitution, a portion of the first attachment. The previously described operation would be identical.

The safety harness represented in FIG. 6 has the advantage of comprising fixing means previously mentioned, that provide the positive blocking of the locking part 13 in its active state by fixing on the second attachment. Thus, the locking part 13, when it occupies its active state itself ensuring the positive blocking of the fastening buckles 11, 12 in their mutual fastening configuration, is fixed by means of a positive blocking to the second attachment by these fixing means. These fixing means comprise first mechanical snap-hitting elements **24*b* secured to the locking part 13 and complementary second mechanical snap-fitting elements 24*a*** secured to the second attachment to which it is fixed.

It is therefore herein understood that, in the second embodiment as represented with the example of FIG. 6, the mechanical elements provide a biasing of the first and second fastening buckles 11, 12 relative to one another when the fastening buckles are in the mutual fastening configuration, by exerting a mechanical tension thereon that opposes the relative displacement of the first and second fastening buckles 11, 12. The slider 26 and housing 25 are adapted to receive a portion of the first attachment and/or a portion of the second attachment, and may also include fixing means **24*a*, 24*b*, The two embodiments described in this document correspond to the same inventive concept and the locking part 13** in both cases corresponds to the same general principles, in particular as regards the mechanical elements that it comprises, even though the structural means for filling its function are different from one embodiment to another.

The safety harness that has just been described has the advantage of being light, simple and economical to manufacture, of enabling a full opening of the strap and a quick adjustment, and of enabling a completely safe harness, by avoiding any risk of accidental opening of the strap 10.

Of course, the invention is not limited to the embodiments represented and described hereinabove, but covers all variants thereof.

The invention claimed is:

1. A safety harness comprising at least one strap and a closure system for closing the strap, with the closure system including a first fastening buckle secured to a first strand of the strap and a second fastening buckle secured to a second strand of the strap, the second fastening buckle being able to cooperate with the first fastening buckle in a mutual fastening configuration in which the strap is closed on itself to form a closed loop, wherein the safety harness comprises a locking part independent of the first and second fastening buckles, the locking part secured to the strap and adapted to vary between a first configuration in which the locking part occupies an active state in which the locking part biases the first and second fastening buckles relative to each other in a manner ensuring a positive blocking of the first and second fastening buckles in the mutual fastening configuration, and a second configuration in which the locking part occupies an inactive state in which the first and second fastening buckles can freely adopt or leave the mutual fastening configuration.

2. The safety harness according to claim 1, wherein the locking part comprises mechanical elements that bias the first and second fastening buckles relative to each other when they are in the mutual fastening configuration by exerting a mechanical tension thereon that opposes a relative displacement between the first and second fastening buckles.

3. The safety harness according to claim 1, wherein the first fastening buckle is fixed by being fixedly secured to the first strand of the strap and the second fastening buckle is movable by being adjustably secured to the second strand of the strap so that the closure system enables an adjustment of the strap such that the closed loop formed when the strap is closed on itself in the mutual fastening configuration of the first and second fastening buckles has an adjustable perimeter by adjusting a position occupied by the second fastening buckle relative to the second strand of the strap.

4. The safety harness according to claim 1, wherein the safety harness further comprises fixing means that provide a positive blocking of the locking part in the active state by fixing on at least one of the first and second fastening buckles.

5. The safety harness according to claim 4, wherein the fixing means comprise mechanical snap-fitting elements and/or magnetic elements.

6. The safety harness according to claim 1, wherein a transition of the locking part from the first configuration to the second configuration and vice versa results from a change of position of the locking part relative to the strap.

7. The safety harness according to claim 6, wherein the locking part is mounted on the strap in a sliding manner, the change of position of the locking part being performed by sliding along the strap.

8. The safety harness according to claim 1, wherein one of the first and second fastening buckles includes a male buckle made of a rigid material and the other of the first and second fastening buckles includes a closed loop-shaped female buckle made of a flexible material, the male buckle being provided to be inserted through the female buckle and to be gripped with the female buckle after insertion.

9. The safety harness according to claim 8, wherein the locking part includes a link formed of a flexible and elastically deformable material and arranged as a closed loop whose ends are fastened to the one of the first and second strands of the strap to which the male buckle is secured and/or to the male buckle, said link being adapted, when in the first configuration corresponding to the active state of the locking part, to trap the female buckle in combination with the male buckle and to exert a mechanical tension on the male and female buckles, thereby preventing the male buckle from leaving the female buckle.

10. The safety harness according to claim 1, wherein the first and second fastening buckles are constituted respectively by first and second attachments adapted to cooperate with each other when the first and second fastening buckles adopt the mutual fastening configuration by simple bearing against each other where the second attachment is superimposed on the first attachment, the first attachment being secured to a free end of the first strand of the strap, the second attachment enabling the second strand of the strap to pass through the second attachment thereby forming a bend in the form of a simple ring, the first and second attachments causing a pinch of the second strand of the strap at a level of said bend between the first and second attachments, a pinch force increasing with a tension applied on the first and second strands of the strap.

11. The safety harness according to claim 10, wherein in the active state, the locking part biases the first and second attachments so as to exert thereon a mechanical tension opposing a relative displacement between the first and second attachments in a manner ensuring a positive blocking of the pinch of the second strand of the strap between the first and second attachments and preventing the second attachment, when in the superimposed position on the first attachment, from passing through an opening of the first attachment through which it has passed to occupy said superimposed position.

12. The safety harness according to claim 10, wherein the locking part delimits a slider mounted in a sliding manner on the second strand of the strap to which the second attachment is secured and a housing in which a portion of the first attachment and/or of the second attachment, when the first and second attachments adopt the mutual fastening configuration by simple bearing, is adapted to be inserted, the slider and the housing being superimposed so that when said portion of the first attachment and/or of the second attachment is inserted into the housing, the locking part, via a connection between the second attachment and the slider of the locking part, opposes the lifting of the second attachment from the first attachment.

13. The safety harness according to claim 10, wherein the locking part can be placed in the first configuration and in the active state if a first face of the second attachment bears against the first attachment and that the locking part cannot be placed in the first configuration and in the active state if a second face of the second attachment, opposite to said first face, bears against the first attachment.

14. The safety harness according to claim 10, wherein the first and second attachments are permanently secured to each other.

15. The safety harness according to claim 10, wherein the locking part is formed of a rigid material.

16. A safety harness comprising at least one strap and a closure system for closing the strap provided with a first fastening buckle secured to a first strand of the strap and a second fastening buckle secured to a second strand of the strap, the second fastening buckle being able to cooperate with the first fastening buckle in a mutual fastening configuration in which the strap is closed on itself to form a closed loop, wherein the safety harness comprises a locking part independent of the first and second fastening buckles, the locking part secured to the strap and adapted to vary between a first configuration in which the locking part occupies an active state in which the locking part applies a biasing force to the first and second fastening buckles that biases the first and second fastening buckles to the mutual fastening configuration, and a second configuration in which the locking part occupies an inactive state in which the biasing force is removed.

17. The safety harness according to claim 16, wherein one of the first and second fastening buckles includes a male buckle made of a rigid material and the other of the first and second fastening buckles includes a closed loop-shaped female buckle made of a flexible material, the male buckle being provided to be inserted through the female buckle and to be gripped with the female buckle after insertion.

18. The safety harness according to claim 17, wherein the locking part includes a link formed of a flexible and elastically deformable material and arranged as a closed loop whose ends are fastened to the one of the first and second strands of the strap to which the male buckle is secured and/or to the male buckle, said link being adapted, when it adopts the first configuration corresponding to the active state, to trap the female buckle in combination with the male buckle and to exert a mechanical tension on the male and female buckles, thereby preventing the male buckle from leaving the female buckle.

* * * * *